US011148448B2

(12) United States Patent
Zheng et al.

(10) Patent No.: US 11,148,448 B2
(45) Date of Patent: Oct. 19, 2021

(54) METHOD FOR PRODUCING COLOR SECURE IDENTIFICATION DOCUMENT AND COLOR SECURE IDENTIFICATION DOCUMENT THEREOF

(71) Applicant: SHENZHEN EMPEROR TECHNOLOGY COMPANY LIMITED, Shenzhen (CN)

(72) Inventors: Song Zheng, Shenzhen (CN); Xiaohong Tang, Shenzhen (CN); Xiaojun Jiang, Shenzhen (CN); Jiange Feng, Shenzhen (CN); Yongbing Hu, Shenzhen (CN)

(73) Assignee: SHENZHEN EMPEROR TECHNOLOGY COMPANY LIMITED, Shenzhen (CN)

( * ) Notice: Subject to any disclaimer, the term of this patent is extended or adjusted under 35 U.S.C. 154(b) by 0 days.

(21) Appl. No.: 16/772,242

(22) PCT Filed: Dec. 12, 2018

(86) PCT No.: PCT/CN2018/120436

§ 371 (c)(1),
(2) Date: Jun. 12, 2020

(87) PCT Pub. No.: WO2020/082532

PCT Pub. Date: Apr. 30, 2020

(65) Prior Publication Data

US 2021/0094332 A1 Apr. 1, 2021

(30) Foreign Application Priority Data

Oct. 23, 2018 (CN) ..... 201811233931.0

(51) Int. Cl.
*B42D 25/378* (2014.01)
*B42D 25/435* (2014.01)
(Continued)

(52) U.S. Cl.
CPC ..... *B41M 3/14* (2013.01); *B41M 1/305* (2013.01); *B41M 3/008* (2013.01);
(Continued)

(58) Field of Classification Search
CPC ..... B42D 25/378; B42D 25/435; B41M 3/14
See application file for complete search history.

(56) References Cited

U.S. PATENT DOCUMENTS 4,006,050 A * 2/1977 Hurst ..... B42D 25/425 156/234
2009/0061159 A1* 3/2009 Staub ..... B42D 25/328 428/161

(Continued)

FOREIGN PATENT DOCUMENTS

CN 1076045 A 9/1993
CN 2755709 Y 2/2006

(Continued)

OTHER PUBLICATIONS

International Search Report dated Jul. 23, 2019 in corresponding International application No. PCT/CN2018/120436; 4 pages.

*Primary Examiner* — Kyle R Grabowski
(74) *Attorney, Agent, or Firm* — Maier & Maier, PLLC

(57) ABSTRACT

The disclosure relates to the technical field of secure identification document, specifically to a method for producing a color secure identification document and a color secure identification document thereof. The method comprises: etching identity information on the substrate of the data surface of document by laser, and the identity information comprises a black-and-white image and text information; printing a color image on the black-and-white image with color ink so that the color image and the black-and-white image are aligned and coincide with each other to form a personalized data surface; and printing a transparent protective layer on the upper surface of the personalized data surface with a transparent varnish, wherein the protective layer covers the color image.

11 Claims, 2 Drawing Sheets

(51) Int. Cl.

| | |
|---|---|
| ***B41M 3/14*** | (2006.01) |
| ***B42D 25/23*** | (2014.01) |
| ***B42D 25/415*** | (2014.01) |
| ***B41M 1/30*** | (2006.01) |
| ***B41M 3/00*** | (2006.01) |
| ***B41M 7/00*** | (2006.01) |
| *B42D 25/309* | (2014.01) |

(52) U.S. Cl.
CPC ..... *B41M 7/0027* (2013.01); *B42D 25/23* (2014.10); *B42D 25/378* (2014.10); *B42D 25/415* (2014.10); *B42D 25/435* (2014.10); *B42D 25/309* (2014.10)

(56) References Cited

U.S. PATENT DOCUMENTS

| | | | | |
|---|---|---|---|---|
| 2009/0251749 | A1* | 10/2009 | O'Boyle | B42D 15/00 359/2 |
| 2011/0139024 | A1* | 6/2011 | Schiffmann | B42D 25/378 101/368 |
| 2016/0096392 | A1* | 4/2016 | Jones | B42D 25/435 283/75 |
| 2019/0315149 | A1* | 10/2019 | Biernacki | B42D 25/435 |
| 2021/0053382 | A1* | 2/2021 | Syrjanen | B42D 25/435 |

FOREIGN PATENT DOCUMENTS

| | | | |
|---|---|---|---|
| CN | 104066589 | A | 9/2014 |
| JP | 6213227 | B2 | 10/2017 |

* cited by examiner

METHOD FOR PRODUCING COLOR SECURE IDENTIFICATION DOCUMENT AND COLOR SECURE IDENTIFICATION DOCUMENT THEREOF

FIELD

The disclosure relates to the technical field of a secure identification document, specifically to a method for producing a color secure identification document and the color secure identification document thereof and a color secure identification document.

BACKGROUND

With the development of society, secure identification documents with identity function, such as passports, ID cards, and driver licenses, have been used more and more widely. To facilitate identity verification, the secure identification document in the prior art is printed with graphic and text identity information of the document holder; therefore, in order to prevent malicious falsification of the identity information on the secure identification document, anti-counterfeiting feature is the basic requirement for modern secure identification document. In the prior art, when a secure identification document is produced, it is necessary to etch the holder's portrait and text identity information on the PC (polycarbonate) substrate of the data surface by laser; as the substrate undergoes irreversible chemical changes after laser etching, it can also effectively prevent falsification of the holder's personal information, and the process thereof is simple and suitable for on-site decentralized document issuance. However, documents produced with holder's black-and-white portrait etched by laser are not artistic and cannot satisfy modern people's aesthetic requirements for the secure identification document.

SUMMARY

The purpose of the invention is to provide a method for producing a secure identification document with the holder's color portrait and the secure identification document thereof.

The purpose of the invention is attained by the following technical solution:

The invention is a method for producing a color secure identification document, comprising:

etching identity information on the substrate of data surface of the document by laser, and the said identity information comprises a black-and-white image and text;

printing a color image on the black-and-white image with color ink and making the color image and the black-and-white image align and coincide with each other to form a personalized data surface; and printing a transparent protective layer on the upper surface of the personalized data surface with a transparent varnish, wherein the protective layer covers the color image.

In the invention, before the transparent protective layer is printed on the upper surface of the personalized data surface, the method comprises:

printing the first anti-counterfeiting mark on the personalized data surface with optically variable ink; and changing the color of the first anti-counterfeiting mark and curing the mark sequentially, so that an optically variable mark is generated on the personalized data surface.

In the invention, the step of printing the transparent protective layer on the upper surface of the personalized data surface with the transparent varnish further comprises:

forming the second anti-counterfeiting marks in the transparent protective layer while the transparent protective layer is printed.

In the invention, there are two or more second anti-counterfeiting marks, which are evenly distributed in the transparent protective layer.

In the invention, before forming the personalized data surface, the method further comprises:

printing color text on the black-and-white text with color ink, and making the color text and the black-and-white text align and coincide with each other.

In the invention, the color ink comprises color resin ink or offset rotary ink; the transparent varnish comprises resin, linseed oil or turpentine; and the substrate comprises polyvinyl chloride or polycarbonate.

In the invention, the first anti-counterfeiting mark and the second anti-counterfeiting marks are composed of a graphic and/or text.

The invention is a color secure identification document, comprising:

a substrate, wherein black-and-white identity information of holder is etched on the substrate, the holder's identity information comprises a black-and-white image and text information; the black-and-white image is covered with a color image layer, and the color image layer and the black-and-white images are aligned and coincide with each other; a transparent protective layer is printed on the substrate, and the transparent protective layer covers the color image layer.

The invention further comprises an optically variable mark layer; the optically variable mark layer is printed with optically variable ink by digital printing, and the optically variable mark layer is between the color image layer and the transparent protective layer.

In the invention, transparent anti-counterfeiting marks are provided in the transparent protective layer.

In the invention, the corresponding color portrait is overlaid and printed on the laser-etched black-and-white portrait, and the color portrait is covered with a transparent protective layer, which effectively prevents falsification of the color portrait; with the holder's color portrait, the secure identification document produced by the invention is more aesthetic and satisfies modern people's aesthetic requirements for secure identification document.

BRIEF DESCRIPTION OF THE DRAWINGS

For ease of description, the invention is described in detail by the following preferred embodiments and the accompanying drawings.

DETAILED DESCRIPTION

Figure 1:
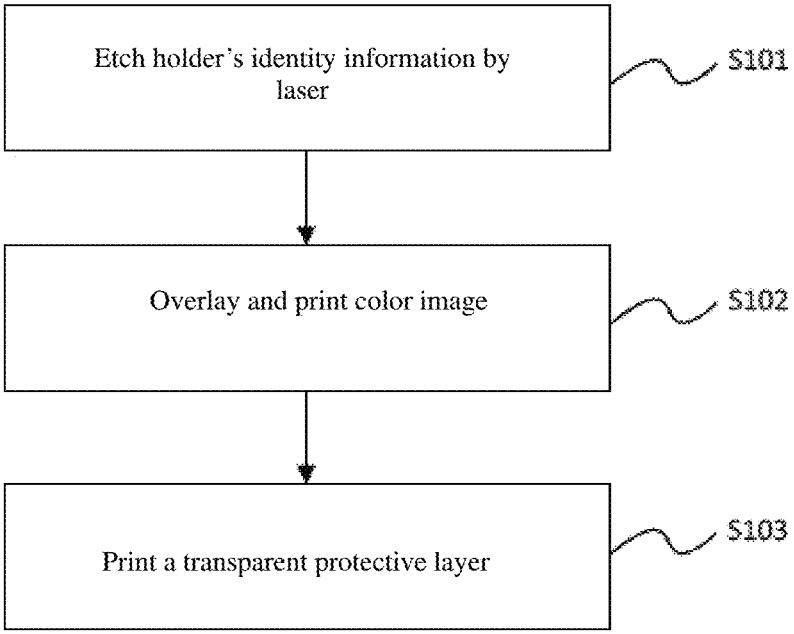
FIG. 1 is a flowchart of an embodiment of a method for producing a color secure identification document according to the invention.

In order to make the objectives, technical solution, and advantages of the invention clearer, the invention is further described in details below with the drawings and embodiments. It should be understood that the specific embodiments described herein are only used to explain the invention and are not intended to limit the invention.

In the description of the invention, it should be understood that the orientation or positional relationship indicated with the terms "center", "longitudinal", "lateral", "length", "width", "thickness", "upper", "lower", "front", "back", "left", "right", "vertical", "horizontal", "top", "bottom", "inside", "outside", "clockwise", "counterclockwise", etc. are based on the orientation or positional relationship shown in the drawings, being only for the convenience of describing the invention and simplifying the description, rather than indicating or implying that a device or an element referred to shall have a specific orientation or shall be configured or operated in a specific orientation. Therefore, it cannot be understood as a limitation to the invention. In addition, the terms "first" and "second" are used for descriptive purposes only and cannot be understood as indicating or implying relative importance or implicitly indicating the number of technical features indicated. Therefore, the features defined as "first" and "second" may explicitly or implicitly comprise one or more of the features. In the description of the invention, the meaning of "plurality" is two or more, unless specifically defined otherwise.

In the description of the invention, it should be noted that the terms "installed", "interconnected", and "connected" should be understood in a broad sense unless explicitly stated and limited otherwise, and for example, the terms "installed", "interconnected", and "connected" may be fixed connection or removable connection, or integrated connection, the terms "installation", "interconnected", and "connected" can be a mechanical connection or an electrical connection. The terms "installation", "interconnected", and "connected" can be directly connected or indirectly connected through an intermediate medium, the terms "installation", "interconnected", and "connected" can be two elements internally communicated or in the interaction. For a person skilled in the art, the specific meanings of the above terms in the invention can be understood according to specific situations.

The following embodiment describes in details a method for producing a secure identification document according to the invention. Please refer to FIG. 1. The method comprises:

S101. Etching Holder's Identity Information by Laser

Holder's identity information is etched on the substrate of the data surface by laser; the holder's identity information comprises a black-and-white image and text information; the black-and-white image comprises a portrait of the holder, and the text information comprises: the holder's name, document number and other text information related to the holder's identity. Due to the high energy of laser, the area of the substrate surface etched can have a change in color, or even a change in surface depth; holder's identity information is etched on the substrate in a destructive manner, so it is difficult to falsify the identify information.

S102. Overlaying and Printing a Color Image

Printing a color image on the black-and-white image with color ink, and making the color image and the black-and-white image align and coincide with each other to form a personalized data surface. In this embodiment, by overlaying and printing a color image on the black-and-white image, the portrait on the secure identification document is more aesthetic; since the black-and-white image is consistent with the color image, it will not match the color image falsified, resulting in a poor visual effect of holder's portrait. This is convenient for people to identify whether the secure identification document has been falsified or not.

S103. Printing a Transparent Protective Layer

A transparent protective layer is printed on the upper surface of the personalized data surface by using a transparent varnish, and the protective layer covers the color image. Since the transparent protective layer covers the color image, it can protect the color image and effectively prevent falling of the color portrait due to daily use.

Figure 2:
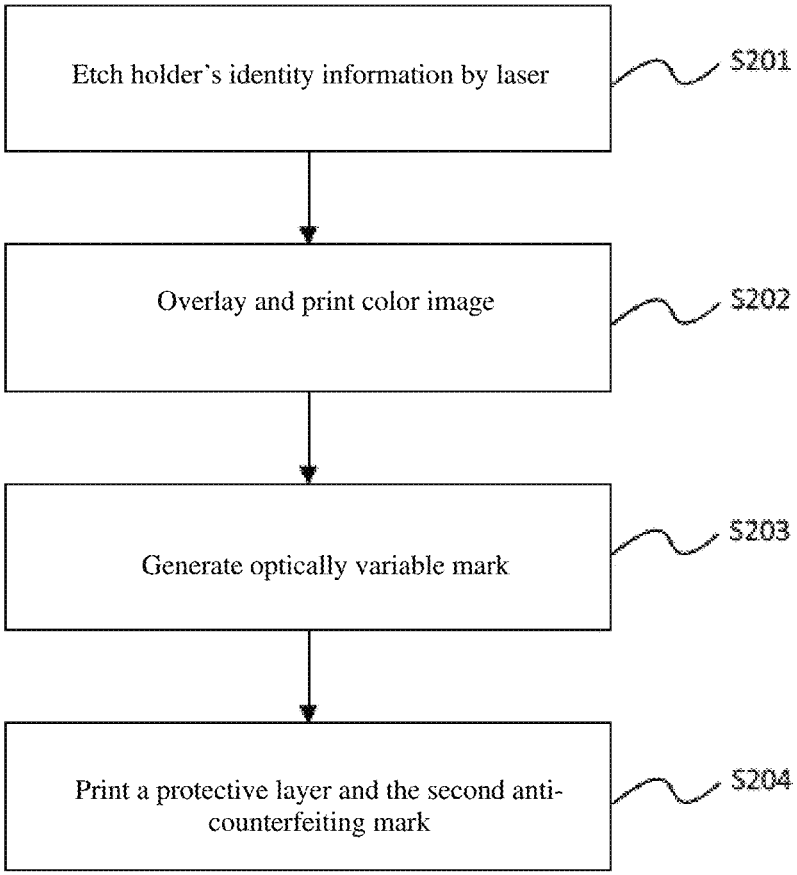
FIG. 2 is a flowchart of another embodiment of a method for producing a color secure identification document according to the invention.

In order to better explain the invention, the method for producing the color secure identification document of the invention is described in details with another embodiment below. Please refer to FIG. 2. The method comprises:

S201. Etching Holder's Identity Information by Laser

The holder's identity information is etched by the laser on the substrate of a data surface; the substrate comprises polyvinyl chloride (PVC) and polycarbonate (PC), and the holder's identity information comprises the black-and-white image and text information; the black-and-white image comprises the portrait of the holder, and the text information comprises the holder's name, the document number, and other text related to the identity of the holder. Due to the high energy of the laser, the region of the substrate surface etched can have a change in color, or even a change in surface depth; the holder's identity information is etched on the substrate in a destructive manner, so it is difficult to falsify the identify information.

S202. Overlaying and Printing the Color Image

Printing a color image on the black-and-white image with color ink, and making the color image and the black-and-white image align and coincide with each other; and printing color text on the black-and-white text information with color ink, and making the color text and the black-and-white text information align and coincide with each other to obtain a personalized data surface. The color ink comprises color resin ink or offset rotary ink. In this embodiment, by overlaying and printing a color image on the black-and-white image, the portrait on the secure identification document is more aesthetic; since the black-and-white image is consistent with the color image, it will not match the color image falsified, resulting in a poor visual effect of holder's portrait. This is convenient for people to identify whether the document has been falsified or not.

S203. Generating an Optically Variable Mark

The first anti-counterfeiting mark is printed on the personalized data surface with optically variable ink; the first anti-counterfeiting mark consists of a graphic and/or text, specifically comprising the graphic and/or text related to the holder's identity information, or comprising graphic and/or text not related to the holder's identity information; for example, the holder's portrait or initials or other information (e.g. a trademark or a name of document issuing authority) can be used as the first anti-counterfeiting mark, which is not defined herein; and the number of the first anti-counterfeiting mark is more than one.

The first anti-counterfeiting mark is sequentially changed in color and cured, so that the optically variable mark is generated on the personalized data surface. Specifically, the color changing process can be realized by gas, electricity, light, or pressure, which is to change the arrangement of liquid crystals. Then, the optically variable mark is rapidly cured by an UV curing agent or ultraviolet light.

Viewed from the front or from the side, the optically variable ink shows two different colors with the change of the viewing angle, with strong optical variability, great color difference, and obvious characteristics. The optically variable ink can be recognized without any equipment, the color angle effect cannot be reproduced with any high-definition scanner, color copier and other equipment, and the printing feature cannot be emulated with any other ink and printing method, showing good anti-counterfeiting reliability. Therefore, optically variable ink has been designated for currency and securities with the strictest anti-counterfeiting requirements in many countries in the world. In this embodiment, the optically variable mark printed with the optically variable ink is provided, which is more conducive to counterfeit prevention of secure identification document.

S204. Printing the Protective Layer and the Second Anti-Counterfeiting Marks A transparent protective layer is printed on the upper surface of the personalized data surface with a transparent varnish, and the protective layer completely or partially covers the color image; since the transparent protective layer is digitally generated on the upper surface of the personalized data surface, the contour and content of the protective layer can be set according to the needs of the document issuance. Second anti-counterfeiting marks are formed in the transparent protective layer while the transparent protective layer is printed; specifically, when the transparent protective layer is printed, the contour of the transparent protective layer is printed as a predetermined graphic and/or text, making the transparent protective layer the second anti-counterfeiting mark; for example, the transparent protective layer is printed in the form of a seal to cover the color image; or when the transparent protection layer is printed, increase or reduce the printing thickness of the predetermined region in the protective layer, so that the second anti-counterfeiting mark with the graphic and/or the text is formed in the predetermined region; and the number of the second anti-counterfeiting mark can be one or more than two; wherein when the number of the second anti-counterfeiting mark is more than two, the second anti-counterfeiting marks are evenly distributed in the transparent protective layer. Since the transparent protective layer covers the color image, the transparent protective layer shall be destroyed before the color image is falsified; because the transparent protective layer is provided with the second anti-counterfeiting mark, when the transparent protective layer is destroyed, part of the content of the second anti-counterfeiting mark is inevitably lost, which is convenient for people to identify whether the content of the document has been falsified; the transparent varnish comprises resin, linseed oil or turpentine; the second anti-counterfeiting mark consists of graphic and/or text, and the content of the second anti-counterfeiting mark can be the same as or different from the content of the first anti-counterfeiting mark.

The invention greatly enhances the anti-counterfeiting ability of the secure identification document by overlaying and printing the color portrait and setting the first and second anti-counterfeiting marks.

Figure 3:
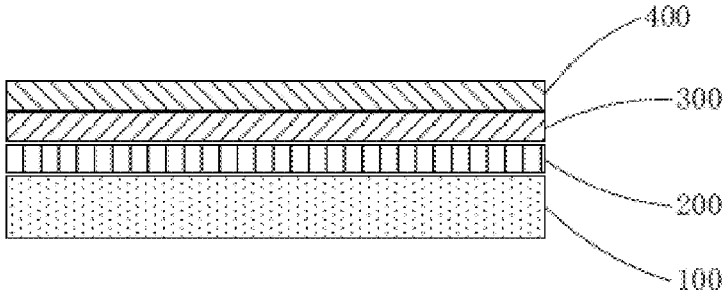
FIG. 3 is a cross-sectional structural diagram of a color secure identification document according to the invention.
Figure 4:
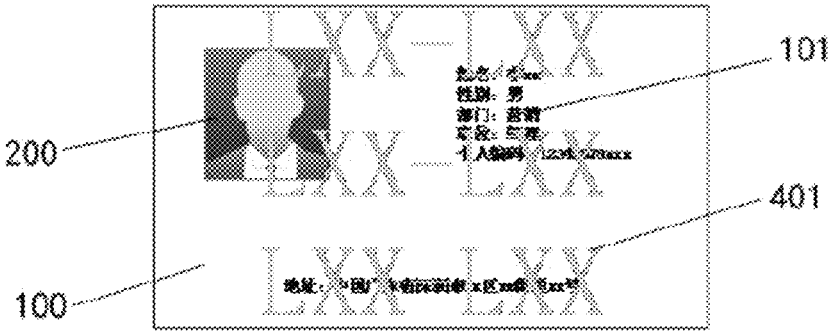
FIG. 4 is a front structural diagram of a color secure identification document according to the invention.

An embodiment of the color secure identification document of the invention is described in details below. Please refer to FIG. 3-FIG. 4. The color secure identification document comprises:

A substrate (100), which comprises polyvinyl chloride or polycarbonate; the substrate (100) is etched with black-and-white identity information of holder (101), and the holder's identity information (101) comprises the black-and-white image and text information; the black-and-white image comprises a portrait of the holder, and the text information comprises the holder's name, the document number and text information related to the holder's identity; the black-and-white image is covered with a color image layer (200), and the color image layer (200) and the black-and-white image are aligned with each other; the transparent protective layer (400) is provided on the substrate (100), and the transparent protective layer (400) completely or partially covers the color image layer (200).

The color image and the black-and-white image are aligned and coincide with each other, so the black-and-white image will not match the color image falsified, resulting in the poor visual effect of the holder's portrait, so it is convenient for people to identify whether the document has been falsified or not; and the transparent protective layer (400) can protect the color image, which effectively prevents the falling of the color image due to daily use.

In the invention, the secure identification document further comprises an optically variable mark layer (300); the optically variable mark layer (300) is printed with optically variable ink by digital printing, and the optically variable mark layer (300) is arranged between the color image layer (200) and the transparent protective layer (400). Viewed from the front or the side, the optically variable ink shows two different colors with the change of the viewing angle, with strong optical variability, great color difference, and obvious characteristics. The optically variable ink can be recognized without any equipment, the color angle effect cannot be reproduced with any high-definition scanner, color copier and other equipment, and the printing feature cannot be emulated with any other ink and printing method, showing good anti-counterfeiting reliability. Therefore, optically variable ink has been designated for currency and securities with the strictest anti-counterfeiting requirements in many countries in the world. In this embodiment, the optically variable mark printed with optically variable ink is provided, which is more favorable for counterfeit prevention of secure identification document.

In the invention, the transparent protective layer (400) is provided with a transparent anti-counterfeiting mark (401). Since the transparent protective layer (400) covers the color image, the transparent protective layer (400) shall be destroyed before the color image is falsified; because the transparent protective layer (400) is provided with the anti-counterfeiting mark (401), when the transparent protective layer (400) is destroyed, part of the content of the anti-counterfeiting mark is inevitably lost, which is convenient for people to identify whether the content of the document has been falsified. The anti-counterfeiting mark (401) may be a Chinese name, initials, the document number, and the like. In this embodiment, the anti-counterfeiting mark comprises initials "LXX", and the initials "LXX" are evenly distributed on the secure identification document.

In the description of this Specification, the descriptions with the terms "an embodiment", "some embodiments", "exemplary embodiments", "examples", "specific examples", or "some examples" mean that the combined embodiments or the specific features, structures, materials, or characteristics described by the examples are included in at least one embodiment or example of the invention. In this Specification, the schematic expressions of the above terms do not necessarily refer to the same embodiment or example. Furthermore, the particular features, structures, materials, or characteristics described may be combined in any suitable manner in any one or more embodiments or examples.

The above descriptions are only the preferred embodiments of the invention and are not intended to limit the invention. Any modification, equivalent replacement, and improvement made within the spirit and principle of the invention shall be included in the protection range of the invention.

The invention claimed is:

1. A method for producing a color secure identification document, comprising:

etching identity information on a substrate of a data surface of document by laser, and the identity information comprises a black-and-white image and text information, wherein the substrate is white and the etched identity information is black;

printing a color image on the black-and-white image with color ink and making the color image and the black-and-white image align and coincide with each other to form a personalized data surface; and printing a transparent protective layer on an upper surface of the personalized data surface with a transparent varnish, and the protective layer covers the color image, wherein when the transparent protective layer is printed, a printing thickness of a predetermined region in the transparent protective layer is increased or reduced, and second anti-counterfeiting marks are formed in the predetermined region.

2. The method for producing a color secure identification document according to claim 1, wherein before the transparent protective layer is printed on the upper surface of the personalized data surface, the method comprises:

printing a first anti-counterfeiting mark on the personalized data surface by using optically variable ink; and changing a color of the first anti-counterfeiting mark and curing the first anti-counterfeiting mark sequentially, so that an optically variable mark is generated on the personalized data surface.

3. The method for producing a color secure identification document according to claim 2, wherein the step of printing a transparent protective layer on the upper surface of the personalized data surface with a transparent varnish further comprises:

forming the second anti-counterfeiting marks in the transparent protective layer while the transparent protective layer is printed.

4. The method for producing a color secure identification document according to claim 3, wherein there are two or more second anti-counterfeiting marks, and the second anti-counterfeiting marks are evenly distributed in the transparent protective layer.

5. The method for producing a color secure identification document according to claim 3, wherein the transparent protective layer covers the color image, the transparent protective layer is destroyed before the color image is falsified, the transparent protective layer is provided with the second anti-counterfeiting mark, and when the transparent protective layer is destroyed, part of a content of the second anti-counterfeiting mark is lost with which a falsified content of the second anti-counterfeiting mark is identified.

6. The method for producing a color secure identification document according to claim 4, wherein, before forming the personalized data surface, the method further comprises:

printing color text on the black-and-white text with color ink, and making the color text and the black-and-white text align and coincide with each other.

7. The method for producing a color secure identification document according to claim 6, wherein the color ink comprises color resin ink or offset rotary ink, and the transparent varnish comprises resin, linseed oil or turpentine, and the substrate comprises polyvinyl chloride or polycarbonate.

8. The method for producing a color secure identification document according to claim 7, wherein the first anti-counterfeiting mark and the second anti-counterfeiting marks are composed of a graphic and/or text.

9. The method for producing a color secure identification document according to claim 2, wherein the changing color of the first anti-counterfeiting mark is processed by gas, electricity, light and pressure, which are to change an arrangement of liquid crystals.

10. The method for producing a color secure identification document according to claim 2, wherein the first anti-counterfeiting mark is cured by an ultraviolet curing agent and ultraviolet light.

11. The method for producing a color secure identification document according to claim 1, wherein the transparent protective layer is printed in a form of a seal to cover the color image.

* * * * *